US008429819B2

(12) United States Patent
Howard

(10) Patent No.: US 8,429,819 B2
(45) Date of Patent: Apr. 30, 2013

(54) SYSTEMS AND METHODS FOR MAKING SEALS IN HEAT EXCHANGERS

(75) Inventor: Erik M. Howard, Baytown, TX (US)

(73) Assignee: Taper-Lok Corporation, Houston, TX (US)

( * ) Notice: Subject to any disclaimer, the term of this patent is extended or adjusted under 35 U.S.C. 154(b) by 187 days.

(21) Appl. No.: 12/859,185

(22) Filed: Aug. 18, 2010

(65) Prior Publication Data

US 2010/0307002 A1 Dec. 9, 2010

Related U.S. Application Data

(62) Division of application No. 11/538,332, filed on Oct. 3, 2006, now Pat. No. 7,854, 254.

(60) Provisional application No. 60/723,132, filed on Oct. 3, 2005.

(51) Int. Cl.
*B23P 15/26* (2006.01)

(52) U.S. Cl.
USPC ..... 29/890.045; 29/890.03; 29/890.036; 29/890.038; 29/890.039; 29/890.04; 165/143; 165/158; 165/173

(58) Field of Classification Search ..... 29/890.03, 29/890.036, 890.038, 890.039, 890.04, 890.045; 165/70, 143, 158, 173
See application file for complete search history.

(56) References Cited

U.S. PATENT DOCUMENTS 3,948,315 A * 4/1976 Powell ..... 165/70

* cited by examiner

*Primary Examiner* — Richard Chang
(74) *Attorney, Agent, or Firm* — Law Offices of Mark L. Berrier

(57) ABSTRACT

Systems and methods for improving heat exchangers by implementing self-energizing seals. In one embodiment, a U-tube heat exchanger includes a shell enclosure, a tube sheet, a closure and a set of tubes welded to the tube sheet. The tube sheet separates first and second chambers from a third chamber in the shell enclosure. The closure seals the first and second chambers. Each tube extends from the first chamber, through the third chamber to the second chamber. The improvement comprises a seal between the shell enclosure and either the closure or the tube sheet. The seal includes conically tapered sealing surfaces on the shell enclosure and closure or tube sheet which form a wedge-shaped gap. A seal ring having surfaces complementary to the sealing surfaces of the shell enclosure and closure or tube sheet is positioned between the sealing surfaces to form a self-energized seal.

11 Claims, 3 Drawing Sheets

SYSTEMS AND METHODS FOR MAKING SEALS IN HEAT EXCHANGERS

CROSS-REFERENCE TO RELATED APPLICATIONS

This application is a divisional application of U.S. patent application Ser. No. 11/538,332, filed Oct. 3, 2006 now U.S. Pat. No. 7,854,254, which claims the benefit of U.S. Provisional Patent Application 60/723,132, filed Oct. 3, 2005, each of which is incorporated by reference as if set forth herein in its entirety.

BACKGROUND

1. Field of the Invention

The invention relates generally to heat exchangers and more particularly to systems and methods for reducing leakage in heat exchangers which can allow fluids to pass between chambers in the heat exchangers and thereby contaminate either the heating/cooling system or the fluid to be heated/cooled.

2. Related Art

The use of heat exchangers to either heat or cool fluids is well known. There are many different types of heat exchangers. Many of these heat exchangers operate by passing fluids of different temperatures on opposite sides of a wall or membrane, so that heat energy from the hotter of the two fluids passes through the wall and into the cooler of the two fluids. For example, one fluid may be passed through a series of tubes that extend through a chamber containing the other fluid. As the fluid passes through the tubes, heat is exchanged through the walls of the tubes between the fluids.

One such type of heat exchanger is a U-tube heat exchanger. An exemplary design is illustrated in FIG. 1. In this figure, a first fluid is circulated into chamber 110, through U-shaped tubes 120 and into chamber 130. A second fluid is circulated in chamber 180 within shell enclosure 140. A tube sheet 150 separates chambers 110 and 130 from the interior of shell enclosure 140. Tube sheet 150 is connected to shell enclosure 140 with a gasket between them in order to create a seal between chambers 110/130 and shell enclosure 140. Each of tubes 120 passes through tube sheet 150 and is welded to the tube sheet to create a fluid passage from chamber 110 to chamber 130. Diaphragm 190 is used to seal chambers 110 and 130, and closure 160 is connected to shell enclosure 140 to provide support to diaphragm 190.

Because the heat exchanger may be used to process hazardous fluids, it is desirable to prevent leakage from chambers 110 and 130. It is also desirable to prevent cross-contamination from fluids passing between chamber 180 and chambers 110 and 130. It is therefore necessary to provide seals between tube sheet 150 and shell enclosure 140, as well as between the shell enclosure and diaphragm 190/closure 160. Conventionally, the seal between tube sheet 150 and shell enclosure 140 is provided by placing a simple gasket between opposing faces of tube sheet 150 and shell enclosure 140. This is shown in FIG. 1B. The seal between shell enclosure 140 and diaphragm 190 is conventional provided by welding the diaphragm to the shell enclosure.

Heat exchangers of the type illustrated in FIG. 1 are used in many applications. For example, this type of heat exchanger may be used in oil refineries for the purpose of cooling crude oil. These heat exchangers are, of course, very large and very expensive. Consequently, when it is necessary to repair one of these heat exchangers, the cost can be enormous, both in terms of the direct cost to repair the heat exchanger and in terms of the cost associated with downtime in the refinery. Because of the cost associated with problems in these heat exchangers, it is very important to minimize these problems to the greatest extent possible.

One of the problems that exists in the conventional heat exchanger design of FIG. 1 is that the temperature of the fluid in chambers 110 and 130 may change repeatedly, causing the materials forming the chambers to repeatedly expand and contract. Over time, this weakens the weld holding diaphragm 190 to shell enclosure 140, and may cause the weld to fail, allowing the fluid in chambers 110 and 130 (which are typically at a high pressure) to leak out of the heat exchanger.

Another problem is that leaks may develop in the seal between chambers 110/130 and chamber 180. This problem can be aggravated by the fact that the conventional gasket has a "blind" seal configuration. In other words, the gasket is positioned between two surfaces where it cannot be kept in position by a worker while the unit is being assembled—the worker is blind to the position of the gasket. As a result, the gasket often becomes pinched or twisted during assembly, so the unit must be disassembled and reassembled with a new gasket. Even when the gasket is properly installed, it is expected that the seal will need to be repaired/remanufactured every two to three years.

Leaks in this type of heat exchanger seal can be a very serious problem. For instance, when this type of heat exchanger is used to cool crude oil, leaks in the seal between the tube sheet and shell enclosure may allow crude oil to contaminate the cooling fluid, which may in turn foul other components of the cooling system. If this occurs, the repairs that are required may become even more extensive than simply replacing the gasket between the tube sheet and the shell enclosure. Even if the cooling system is not damaged, the cost of simply repairing the heat exchanger may easily be in the range of $500,000 to $800,000. While this amount may at first appear to be exorbitantly high, it should be noted that the repair is no simple task and includes: costs associated with shutting down the heat exchanger unit; the cost of the use of a crane which is necessary for assembly and disassembly of the unit; replacement of sealing surfaces (e.g., grinding down or un-welding stainless steel covers); heat treating repaired/remanufactured components; purging the heat exchanger; hydrogen bake-out; materials; labor; etc.

SUMMARY OF THE INVENTION

This disclosure is directed to systems and methods for making seals in heat exchangers that solve one or more of the problems discussed above. In one particular embodiment, the heat exchanger comprises a shell enclosure, a tube sheet, a closure and a set of tubes welded to the tube sheet. The tube sheet separates first and second chambers from a third chamber in the shell enclosure. The closure seals the first and second chambers. Each tube has a first end terminating at the first chamber and a second end terminating at the second chamber. The tubes extend through the tube sheet into the third chamber. The improvement comprises a seal between the shell enclosure and either the closure or the tube sheet. The seal includes an inward-facing conically tapered sealing surface on the shell enclosure and an outward-facing conically tapered sealing surface on the closure or tube sheet. A tapered seal ring having surfaces complementary to the sealing surfaces of the shell enclosure and closure or tube sheet is positioned between the sealing surfaces of the shell enclosure and the closure or tube sheet in a wedge-shaped gap to form a self-energized seal.

Another embodiment comprises a method for retrofitting a U-tube heat exchanger. The heat exchanger has a shell enclosure, a tube sheet and a plurality of tubes as described above. Originally, the heat exchanger is configured to use conventional seals between the shell enclosure and tube sheet, and/or between the shell enclosure and closure, but the shell enclosure and tube sheet and/or closure are modified to have conically tapered sealing surfaces.

In the above embodiments, the self-energized seal may be formed between the shell enclosure and the closure, or between the shell enclosure and the tube sheet. Alternatively, self-energized seals may be formed between both the shell enclosure and the closure, and between the shell enclosure and the tube sheet. The seals may be configured to be energized by higher pressure on one side of the seal or the other. The seals may be implemented in original components, or they may be retrofitted into components that were originally manufactured with conventional seals. Retrofitted seals may utilize sealing faces that are machined into the original components, or they may make use of spacers or other parts that are welded or otherwise connected to the original components to provide the self-energized seals.

Numerous other embodiments are also possible.

BRIEF DESCRIPTION OF THE DRAWINGS

Other objects and advantages of the invention may become apparent upon reading the following detailed description and upon reference to the accompanying drawings.

Figures 1A, 1B, 1C:
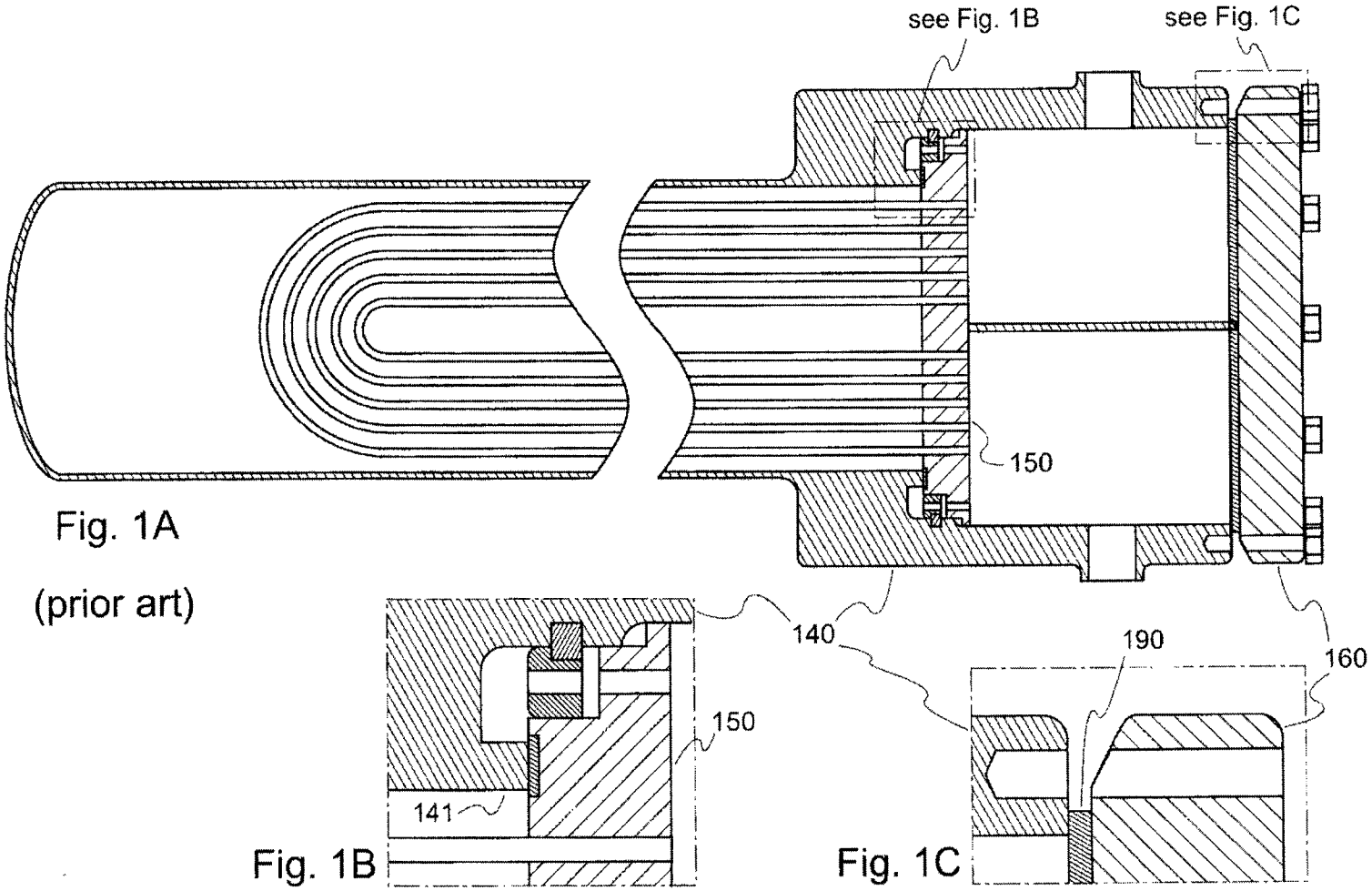
Fig. 1A (prior art)
FIGS. 1A-1C are diagrams illustrating the structure of a U-tube heat exchanger in accordance with the prior art.

It should be noted that the drawings are intended to illustrate the various features of the disclosed heat exchangers to facilitate the description of the invention. The drawings are simplified for the purposes of clarity in the description and do not contain all of the detail that would be found in manufacturing drawings, nor are they necessarily drawn to scale.

While the invention is subject to various modifications and alternative forms, specific embodiments thereof are shown by way of example in the drawings and the accompanying detailed description. It should be understood, however, that the drawings and detailed description are not intended to limit the invention to the particular embodiment which is described. This disclosure is instead intended to cover all modifications, equivalents and alternatives falling within the scope of the present invention as defined by the appended claims.

DETAILED DESCRIPTION OF EXEMPLARY EMBODIMENTS

One or more embodiments of the invention are described below. It should be noted that these and any other embodiments described below are exemplary and are intended to be illustrative of the invention rather than limiting.

As described herein, various embodiments of the invention comprise systems and methods for improving heat exchangers by implementing self-energized seals between chambers of the heat exchangers, and at the closures of the heat exchangers.

In one embodiment, the heat exchanger comprises a U-tube heat exchanger. The heat exchanger includes a shell enclosure, a tube sheet, a closure and a set of tubes welded to the tube sheet. The tube sheet separates first and second chambers from a third chamber in the shell enclosure. The closure seals the first and second chambers. Each tube has a first end terminating at the first chamber and a second end terminating at the second chamber. The tubes extend through the tube sheet into the third chamber.

The improvement in the heat exchanger comprises a seal between the shell enclosure and either the closure or the tube sheet. The seal includes an inward-facing conically tapered sealing surface on the shell enclosure and an outward-facing conically tapered sealing surface on the closure or tube sheet. A tapered seal ring having surfaces complementary to the sealing surfaces of the shell enclosure and closure or tube sheet is positioned between the sealing surfaces of the shell enclosure and the closure or tube sheet in a wedge-shaped gap to form a self-energized seal.

The self-energized seal may be formed between the shell enclosure and the closure, or between the shell enclosure and the tube sheet. Alternatively, self-energized seals may be formed between both the shell enclosure and the closure, and between the shell enclosure and the tube sheet. The seals may be configured to be energized by higher pressure on one side of the seal or the other. The seals may be implemented in original components, or they may be retrofitted into components that were originally manufactured with conventional seals. Retrofitted seals may utilize sealing faces that are machined into the original components, or they may make use of spacers or other parts that are welded or otherwise connected to the original components to provide the self-energized seals.

Figures 2A, 2B, 2C:
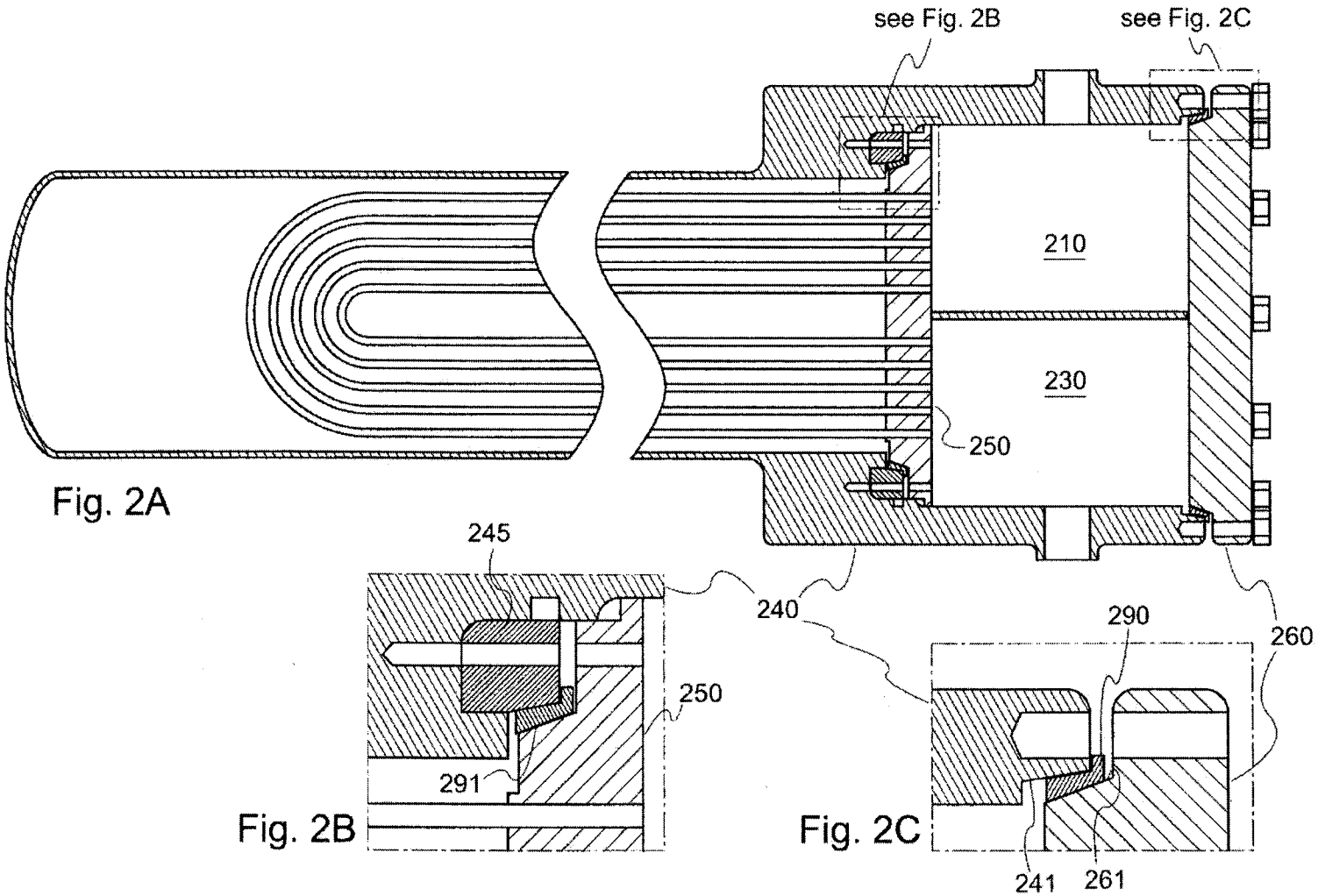
FIGS. 2A-2C are diagrams illustrating the structure of a U-tube heat exchanger utilizing self-energized seals in accordance with one embodiment of the invention.

Referring to FIGS. 2A-2C, an exemplary U-tube heat exchanger is illustrated. FIG. 2A is a cross-sectional view of the heat exchanger. FIG. 2B is an enlarged view of the configuration of the seal between the closure and shell enclosure of the heat exchanger. FIG. 2C is an enlarged view of the configuration of the seal between the tube sheet and shell enclosure of the heat exchanger.

The overall configuration and operation of the heat exchanger is essentially the same as that of the heat exchanger illustrated in FIG. 1. That is, the two fluids flow through the unit in the same manner and effect a heat exchange between the two fluids as described above in connection with FIG. 1. The unit illustrated in FIG. 2, however, is different in that it uses a different mechanism for creating seals between the closure (and/or tube sheet) and the shell enclosure of the unit. This mechanism is shown in FIG. 2C (and/or 2B.)

Referring to FIG. 2C, rather than having a diaphragm welded to the shell enclosure and backed by the closure as shown in FIGS. 1A and 1C, a self-energized seal is used. It can be seen that shell enclosure 240 has been modified to include a tapered surface 241, while closure 260 has been modified to include tapered surface 261. Since shell enclosure 240 and closure 260 are essentially symmetric around an axis of the heat exchanger, tapered surfaces 241 and 261 form conic sections. A seal ring 290 is positioned between surfaces 241 and 261. The faces of seal ring 290 are tapered so that they are complementary to sealing surface 241 of shell enclosure 240 and sealing surface 261 of closure 260. When closure 260 is bolted to shell enclosure 240, contact pressure is applied between the conically tapered surfaces of seal ring 290 and sealing surfaces 241 and 261, sealing chambers 210 and 230.

It can be seen from FIG. 2C that the angles of surfaces 241 and 261 with respect to the axis of the heat exchanger are slightly different, so that the gap between these surfaces (as well as seal ring 290) has a wedge-shaped cross-section with the wider end of the wedge facing chambers 210 and 230. In this embodiment, the pressure of the fluid within chambers 210 and 230 is higher than the pressure external to shell enclosure 240, so the pressure within these chambers forces seal ring 290 more tightly into the gap, ensuring a tight seal. This type of seal is referred to herein as being "self-energized."

Referring to FIG. 2B, it can be seen that the conventional mechanism for providing a seal between the tube sheet and shell enclosure (having a flat gasket between flat sealing surfaces as shown in FIG. 1B) is also replaced by a self-energized, tapered seal. In this new seal, the shell enclosure protrusion (141) of the conventional seal is removed and a spacer 245 is welded to the shell enclosure in its place. A tapered seal ring 291 is positioned between corresponding tapered surfaces of the tube sheet 250 and spacer 245. The angles at which tube sheet 250 and spacer 245 are tapered differ slightly so that the gap between them has a wedge-shaped cross-section. In this embodiment, the end of the gap nearest the interior of shell enclosure 240 is slightly wider than the end of the gap which is farthest from the interior of the shell enclosure. Seal ring 291 is tapered in the same manner. As a result, when tube sheet 250 is installed, the pressure in the chamber to the left of the tube sheet (which, in this embodiment, is higher than the pressure in the chambers to the right of the tube sheet) wedges tapered seal ring 291 more tightly into the tapered gap and energizes the seal.

As pointed out above, the design of FIG. 2 uses a spacer 245 which has a tapered contact surface which forms a female pocket in which tapered seal ring 291 is seated. In this embodiment, spacer 245 is positioned so that it abuts shell enclosure 240 and is then welded in place. It can be seen in the figure that the corners of spacer 245 are beveled or chamfered to form a gap between itself and the shell enclosure. This gap is filled by the weld between the two components. Although the design of FIG. 2 includes threaded bolt holes that extend into shell enclosure 240, the bolt holes in alternative embodiments could extend only into spacer 245, or closure 250 could be held in place using a split ring and spacer mechanism similar to the one shown in the conventional system of FIG. 1B.

The heat exchanger seals shown in FIGS. 2A-2C provide a number of advantages over conventional designs. For instance, because the seals are self-energized, they tend to form a better seal than a simple gasket (e.g., as conventionally used between the tube sheet and the shell enclosure.) Another benefit is that the tapered seal is more durable and more easily assembled/disassembled than the welded-on diaphragm conventionally used to seal the shell enclosure at the junction with the closure. Further, the materials from which the tapered seal rings are manufactured remain within their elastic limits in the assembled heat exchanger rather than being deformed. Still another benefit is that the use of tapered seal rings reduces the stress on the bolts connecting the closure (or tube sheet) to the shell enclosure, so that they are less susceptible to hydrogen embedment and resulting brittleness. Still another benefit is that the use of similar materials in the closure, tube sheet and shell enclosure reduces bimetallic corrosion and problems associated with different coefficients of expansion. Still another benefit is that the conically tapered sealing surfaces on the shell enclosure form female pockets into which the tapered seal rings fit (and the tapered seal rings likewise form pocket into which the male noses of the closure and tube sheet fit) the seal ring is not prone to slip out of place in the same manner as a gasket in a conventional design. As a result, the new design does not incur costs associated with slippage of and resulting damage to gaskets and associated assembly/disassembly time. Still further, the male noses (of the closure and tube sheet) and female pockets of the shell enclosure facilitate assembly of the unit because the closure and tube sheet are guided into the proper position to be connected to the shell enclosure.

Figure 3A:
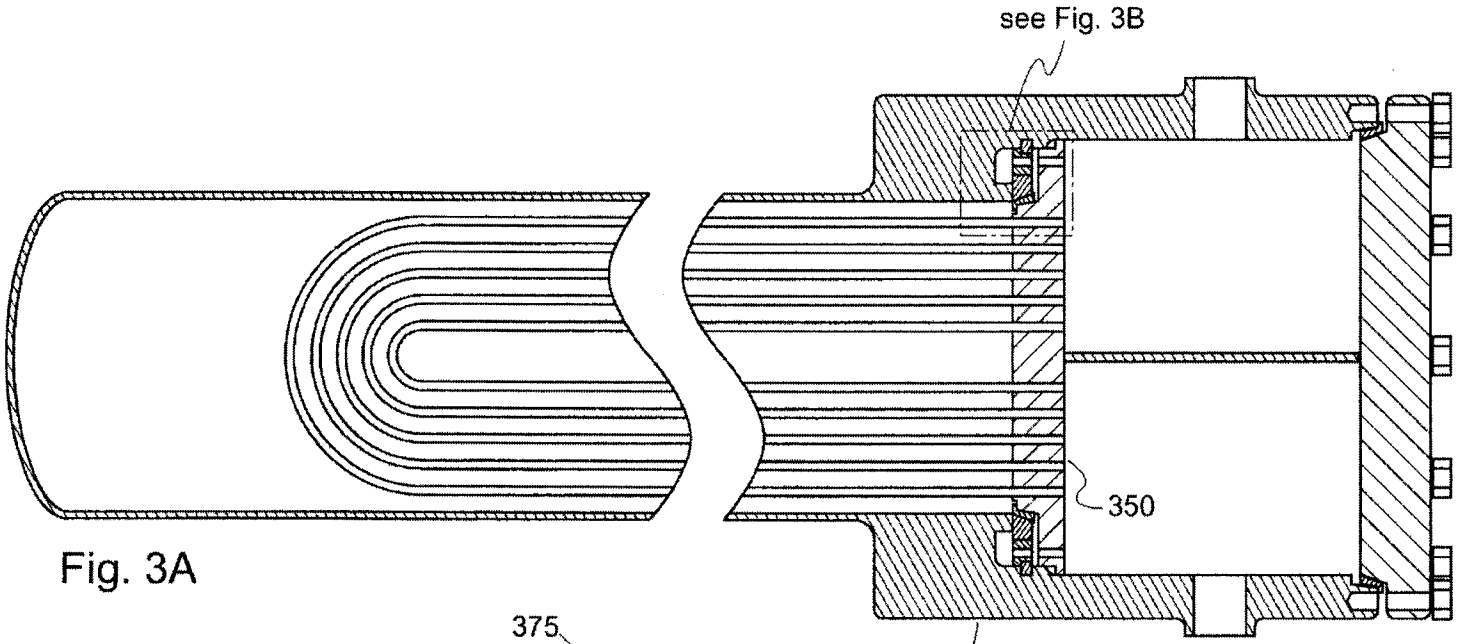
FIG. 3 is a diagram illustrating the structure of a self-energized seal in accordance with an alternative embodiment of the invention.
Figure 3B:
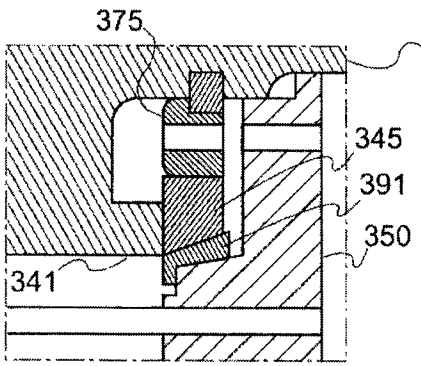

The seal configurations illustrated in FIGS. 2A-2C are merely exemplary of the many configurations that are possible. One alternative embodiment for the seal between the tube sheet and shell enclosure is shown in FIG. 3. In this embodiment, it is not necessary to remove the protrusion (141) from the shell enclosure. Instead, spacer 345 is welded to the end of the protrusion (341). Spacer 345 includes the inward-facing sealing surface that will contact the tapered seal ring 391. The side of spacer 345 which is opposite the conically tapered sealing surface abuts spacer 375, which provides support to spacer 345 when contact pressure is applied between the sealing surface of spacer 345 and seal ring 391. In this embodiment, tube sheet 350 is machined to provide an outward-facing conically tapered sealing surface. As in the embodiment described above, the sealing surfaces of tube sheet 350 and shell enclosure 340 (spacer 345) are tapered at slightly different angles so that the gap between them is wedge-shaped. In contrast to the embodiment of the FIG. 2B, however, the wider end of the gap in this embodiment faces the chambers on the right side of tube sheet 350. This is because, in this embodiment, the pressure in the chambers to the right of tube sheet 350 is higher than the pressure in the chamber to the left of the tube sheet. The higher pressure in the chambers to the right of tube sheet 350 therefore wedges tapered seal ring 391 more tightly into the gap.

In various alternative embodiments, the conically tapered sealing surfaces of the closure, tube sheet and shell enclosure may be provided by machining these surfaces directly into the respective components, or they may be provided by attaching (e.g., welding) appropriately formed spacers or similar pieces to the original or modified components of the heat exchanger. Alternative embodiments may also implement the disclosed self-energized seals in only one of the locations (i.e., only in the closure/shell enclosure seal, or only in the tube sheet/shell enclosure seal.)

It should be noted that embodiments of the present invention include new heat exchangers that are originally manufactured with tapered seals similar to those shown in FIGS. 2 and 3. There are, however, many heat exchangers which are already in use that suffer from the disadvantages of their conventional design, as noted above. It is therefore contemplated that one of the most useful embodiments of this invention may be a method for repairing or retrofitting these conventionally designed heat exchangers to utilize the seal mechanism described herein. The designs shown in FIGS. 2 and 3 make use of components that are adapted for such repair/retrofit embodiments.

One embodiment of a method for repairing heat exchangers in accordance with the present invention comprises the following steps. First, the heat exchanger is disassembled. For example, closure 160 may be unbolted from shell enclosure 140 and removed, along with diaphragm 190. Then, tube sheet 150 can be unbolted and removed from the shell enclosure, along with heat exchanger tubes 120.

Referring to FIG. 2C, the retrofit of the closure seal is accomplished by machining conically tapered sealing surface 261 into closure 260 and machining surface 241 into shell enclosure 240. Sealing surfaces 241 and 261 are, as noted above, complementary to the corresponding surfaces of tapered seal ring 290, which will be positioned between them when the closure is reinstalled. In alternative embodiments, sealing surfaces 241 and 261 may be provided by welding appropriately formed spacers or other components onto the closure and shell enclosure.

Referring to FIG. 1B, there is a protrusion 141 which acts as a spacer between tube sheet 150 and shell enclosure 140. In some designs, this protrusion is part of the tube sheet instead of the shell enclosure. The purpose of the protrusion in either case is to maintain a gap between shell enclosure 140 and spacer 175 so that the spacer, when unbolted, can be moved away from the tube sheet and into the gap, allowing the tube sheet to be removed. As part of the repair process, protrusion 141 may removed, whether it is part of shell enclosure 140 or tube sheet 150. Alternatively, protrusion 141 may be used to form one of the desired tapered sealing surfaces.

With tube sheet 150 removed from shell enclosure 140, the edge of the tube sheet near the seating surface for the gasket is machined to form a tapered contact surface, as shown in FIG. 2 (item 250.) Spacer 245, which is preferably manufactured prior to disassembly of the heat exchanger unit, has a corresponding tapered contact surface. Spacer 245 is positioned in shell enclosure 240 and welded in place. As shown in FIG. 2B, spacer 245 is welded to shell enclosure 240 at the lower, left-hand edge and the upper, right-hand edge of the spacer. The dimensions of spacer 245 are preferably such that the same spacing is maintained between the tube sheet and shell enclosure as when the conventional seal configuration is used. If it is desired to provide a threaded hole in shell enclosure 240 to receive a bolt, this hole may be bored and threaded either before or after installation of spacer 245.

After spacer 245 has been installed, tapered seal ring 291 is positioned in the female pocket formed by the contact surface of spacer 245. Tube sheet 250 is then positioned with the nose formed by its tapered contact surface in the pocket formed by tapered seal ring 291. Bolts are then inserted through spacer 245 and into the threaded holes in shell enclosure 240 and tightened to draw tube sheet 250 against seal ring 291 and spacer 245, thereby sealing the interior of shell enclosure 240. Seal ring 290 is then positioned against sealing surface 241 and closure 260 is positioned with sealing surface 261 against the seal ring. When closure 260 is bolted to shell enclosure 240, contact pressure is applied between the sealing surfaces and the seal ring, thereby sealing chambers 210 and 230.

It should be noted that the configuration of the seals between the closure and/or tube sheet and the shell enclosure (utilizing the tapered sealing surfaces and seal ring) should not need to be repaired or replaced for the remainder of the life of the heat exchanger unit. This is a result of several factors. For instance, a self-energizing seal as described above is much more reliable than a simple gasket between flat sealing surfaces. Further, tapered seal rings are typically much more durable than the type of gasket which is used in conventional heat exchanger designs. Still further, the seals are not subject to fatigue from repeated expansion and contraction, as are the diaphragm seals of conventional designs. Still further, because of the manner in which the tapered seal ring is seated within the female pocket of the spacer, it is very unlikely that the seal ring will slip out of position during installation and become damaged as a result of being mispositioned.

While the foregoing description focuses on a repaired/retrofitted heat exchanger and a method for performing the repair/retrofit, there may be numerous other embodiments of the invention. For example, one embodiment may utilize a spacer (e.g., 245) which is configured to be welded to the shell enclosure, closure or tube sheet to provide a conically tapered sealing surface as in the described repair/retrofit procedure. Another alternative embodiment may comprise a machined closure, tube sheet or shell enclosure machined to provide tapered sealing surfaces for use in the described repaired/retrofitted heat exchanger. Still other embodiments may be apparent to persons of skill in the art of the invention upon reading this disclosure. All of these embodiments are intended to be within the scope of this disclosure.

The benefits and advantages which may be provided by the present invention have been described above with regard to specific embodiments. These benefits and advantages, and any elements or limitations that may cause them to occur or to become more pronounced are not to be construed as critical, required, or essential features of any or all of the claims. As used herein, the terms "comprises," "comprising," or any other variations thereof, are intended to be interpreted as non-exclusively including the elements or limitations which follow those terms. Accordingly, a system, method, or other embodiment that comprises a set of elements is not limited to only those elements, and may include other elements not expressly listed or inherent to the claimed embodiment.

The preceding description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein and recited within the following claims.

What is claimed is:

1. A method for retrofitting a U-tube heat exchanger, the method comprising:

providing a U-tube heat exchanger having a shell enclosure having first, second and third chambers therein, a tube sheet separating first and second chambers from a third chamber in the shell enclosure, and a plurality of tubes extending through the tube sheet into the third chamber, wherein each tube has a first end in fluid communication with the first chamber and a second end in fluid communication with the second chamber;

forming a first inward-facing conically tapered sealing surface on the shell enclosure;

forming an outward-facing conically tapered sealing surface on one of the group consisting of the closure and the tube sheet;

wherein the first sealing surface of the shell enclosure and the sealing surface of the closure or the tube sheet form a first gap having a wedge-shaped cross-section;

providing a first tapered seal ring having an outward-facing conically tapered surface complementary to the first sealing surface of the shell enclosure and an inward-facing conically tapered surface complementary to the sealing surface of the closure or the tube sheet;

positioning the first seal ring in the first gap; and coupling the closure or the tube sheet to the shell enclosure.

2. The method of claim 1, wherein the first seal is between the shell enclosure and the closure and seals an interior of the shell enclosure from an exterior of the shell enclosure, further comprising forming a second inward-facing conically tapered sealing surface on the shell enclosure which is separate from the first inward-facing conically tapered sealing surface on the shell enclosure;

forming an outward-facing conically tapered sealing surface on the tube sheet;

wherein the second sealing surface of the shell enclosure and the sealing surface of the tube sheet form a second gap having a wedge-shaped cross-section;

providing a second tapered seal ring which is separate from the first seal ring, the second seal ring having an outward-facing conically tapered surface complementary to the second sealing surface of the shell enclosure and an inward-facing conically tapered surface complementary to the sealing surface of the tube sheet;

positioning the second seal ring in the second gap; and coupling the tube sheet to the shell enclosure, thereby sealing the first and second chambers from the third chamber.

3. The method of claim 2, wherein the closure comprises a blind closure that does not have a passageway therethrough.

4. The method of claim 3, wherein the shell enclosure includes a first port therein which enables fluid to flow into the first chamber within the shell enclosure, and a second a port therein which enables fluid to flow out of the second chamber within the shell enclosure.

5. The method of claim 2, wherein the outward-facing conically tapered sealing surface of the closure forms a first male nose member, the first inward-facing conically tapered sealing surface of the shell enclosure forms a first female socket member, and wherein the first male nose member mates with the first female socket member; and wherein the outward-facing conically tapered sealing surface of the tube sheet forms a second male nose member, the second inward-facing conically tapered sealing surface of the shell enclosure forms a second female socket member, and wherein the second male nose member mates with the second female socket member.

6. The method of claim 1, wherein forming the inward-facing conically tapered sealing surface on the shell enclosure comprises welding a spacer ring to the shell enclosure, the spacer ring having the inward-facing conically tapered sealing surface.

7. The method of claim 1, wherein forming the inward-facing conically tapered sealing surface on the shell enclosure comprises machining the inward-facing conically tapered sealing surface into the shell enclosure.

8. The method of claim 1, wherein forming the outward-facing conically tapered sealing surface on the tube sheet comprises welding a spacer ring to the closure or the tube sheet, the spacer ring having the outward-facing conically tapered sealing surface.

9. The method of claim 1, wherein forming the outward-facing conically tapered sealing surface on the closure or the tube sheet comprises machining the outward-facing conically tapered sealing surface into the tube sheet.

10. The method of claim 1, wherein the wedge-shaped cross-section of the first gap has a wider end facing the first and second chambers.

11. The method of claim 1, wherein the wedge-shaped cross-section of the first gap has a wider end facing the third chamber.

* * * * *